US005437401A

United States Patent [19]

Seltzer

[11] Patent Number: 5,437,401

[45] Date of Patent: Aug. 1, 1995

[54] PERSONAL HARNESS FOR CARRYING ARTICLES

[76] Inventor: Richard Seltzer, 55 River Rd., Flanders, N.J. 07836

[21] Appl. No.: 192,376

[22] Filed: Feb. 7, 1994

[51] Int. Cl.[6] ..... A45F 3/02

[52] U.S. Cl. ..... 224/151; 224/153; 224/202; 224/205; 224/258; 224/250; 294/149

[58] Field of Search ..... 224/150, 151, 153, 155, 224/202, 205, 209, 214, 250, 254, 257–260; 294/147, 149, 150, 157

[56] References Cited

U.S. PATENT DOCUMENTS

| | | | |
|---|---|---|---|
| 54,807 | 5/1866 | Woods | 224/214 X |
| 435,101 | 8/1890 | Von Mann-Tiechler | 224/202 |
| 1,310,958 | 7/1919 | O'Connor | 224/260 X |
| 1,332,088 | 2/1920 | Wagner | 224/150 |
| 2,446,197 | 8/1948 | Sloan | 224/150 |
| 2,812,123 | 11/1957 | Girton | 224/151 X |
| 3,317,098 | 5/1967 | Auraen | 224/254 X |
| 4,676,417 | 6/1987 | Hirschkoff | 224/202 |
| 4,790,462 | 12/1988 | Kawaguchi | 224/250 |
| 4,823,998 | 4/1989 | Johnson | 224/150 |
| 4,827,578 | 5/1989 | Heckerman et al. | 224/150 X |
| 4,867,359 | 9/1989 | Donovan | 224/202 |
| 4,903,875 | 2/1990 | Smart et al. | 224/258 |
| 4,911,347 | 3/1990 | Wilhite | 224/257 |
| 4,953,768 | 9/1990 | Muse | 224/205 |
| 4,978,044 | 12/1990 | Silver | 224/202 |
| 5,082,155 | 1/1992 | Salvador | 224/150 |
| 5,119,910 | 6/1992 | Heggeland | 190/116 |
| 5,143,266 | 9/1992 | Heckerman et al. | 224/150 |
| 5,160,074 | 11/1992 | Coates | 224/257 |
| 5,165,584 | 11/1992 | Meagher et al. | 224/258 |
| 5,370,286 | 12/1994 | Newman | 224/151 |

FOREIGN PATENT DOCUMENTS

| | | | |
|---|---|---|---|
| 2033980 | 11/1971 | Germany | 224/155 |
| 0022158 | of 1904 | United Kingdom | 224/214 |

OTHER PUBLICATIONS

Brown Cor International Catalog #941 Jan./Apr. 1994 edition p. 24.

*Primary Examiner*—J. Casimer Jacyna
*Attorney, Agent, or Firm*—Thomas L. Adams

[57] ABSTRACT

A personal harness can carry at least one article. The harness has a shoulder strap having a pair of carrying ends. The harness also has a pair of hitching devices for holding at least that one article. This pair of hitching devices is separately attached to the shoulder strap near the pair of carrying ends. Each of the hitching devices has a cinch strap, a clasp, and a primary slide. The primary slide is slidably mounted on the shoulder strap. The cinch strap is attached to the primary slide. The clasp can detachably join the cinch strap and the corresponding one of the carrying ends of the shoulder strap. The harness is used by encircling at least the one article with the shoulder strap and the respective cinch strap, with the clasp opened. After closing the respective clasp, one can carry at least that one article by shouldering the shoulder strap and walking.

11 Claims, 2 Drawing Sheets

FIG. 6A
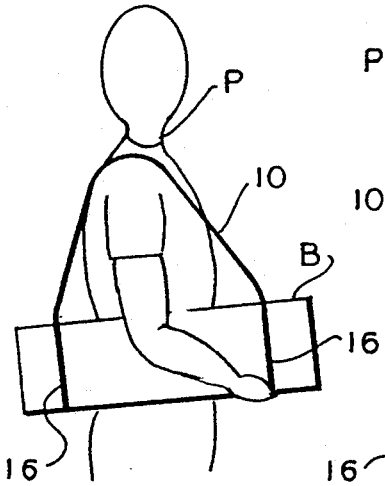
FIG. 6B
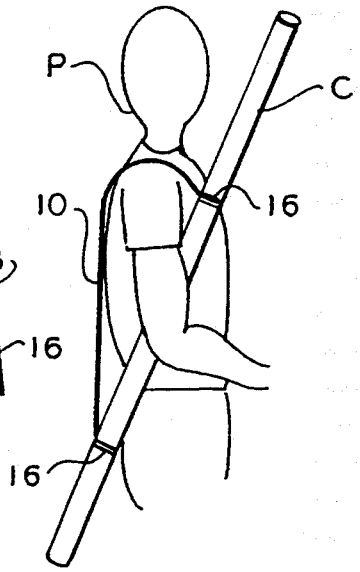
FIG. 6C
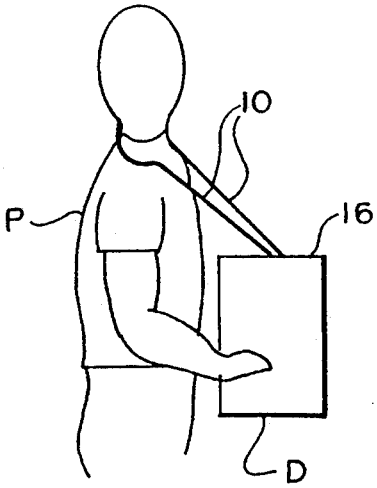
FIG. 6D
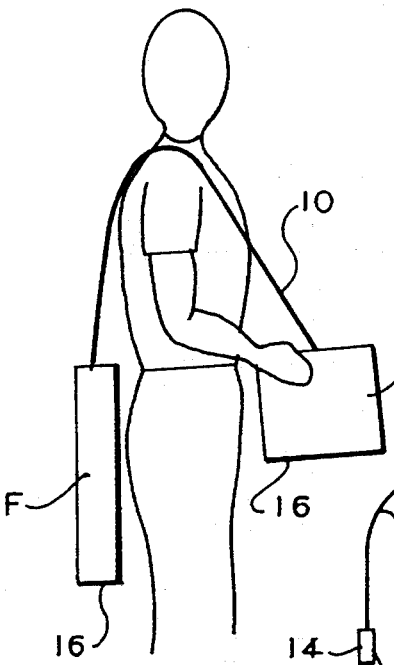
FIG. 7
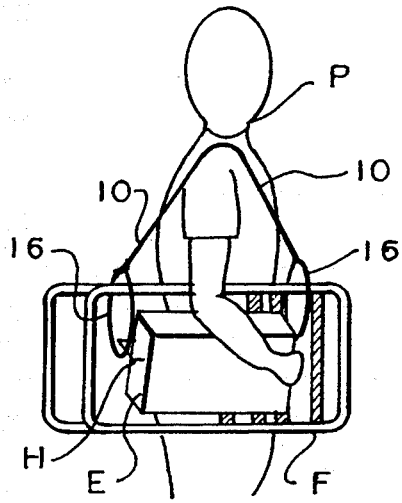
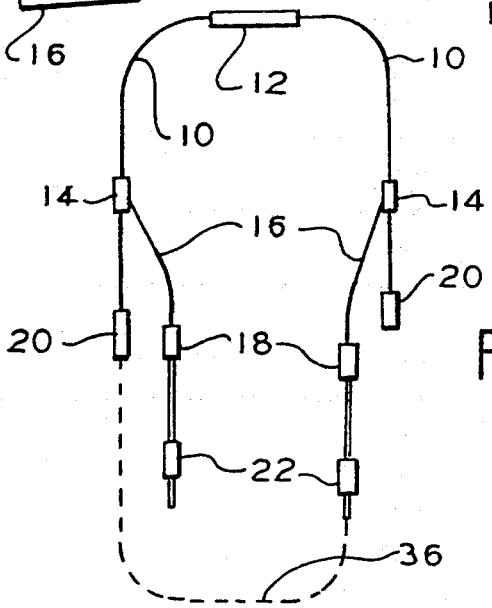
FIG. 8

PERSONAL HARNESS FOR CARRYING ARTICLES

BACKGROUND OF THE INVENTION

1. Field of the Invention

The present invention relates to harnesses for carrying articles and in particular to a device having a shoulder strap and a clasp.

2. Description of Related Art

People often need to carry a large number of items when visiting the beach, shopping, skiing or engaging in any number of activities. Often the objects to be carried are cumbersome and a lightweight product is needed to facilitate such transportation.

For example in U.S. Pat. No. 5,165,584 a strap has on one end a loop for encircling the shoulder of an archer. The opposite end of the strap has an adjustable buckle and a quick release buckle leading to a Velcro band for encircling and holding a bow. This carrying device is dedicated to carrying a bow and is not easily adapted to carrying a variety of objects on either end of the strap.

U.S. Pat. No. 5,160,074 shows a strap with two forked ends employing Velcro fasteners to wrap around a pair of skis so they can be carried on a skier's shoulder. This device is dedicated to carrying skis and cannot be readily adapted for carrying a variety of articles such as large, bulky articles.

U.S. Pat. No. 4,676,417 shows another ski carrier that can be reconfigured after the skis are delivered and worn around the skier's waist. See also the ski carrying device of U.S. Pat. No. 4,903,875.

U.S. Pat. Nos. 4,867,359 and 4,953,768 show a network of shoulder straps and adjustable loops for carrying such articles as a golf bag or ski boots. See also U.S. Pat. Nos. 435,101; 4,911,347; 4,978,044; 5,119,910; and 5,143,266.

Accordingly, there is a need for a simple and lightweight device for carrying articles with a shoulder strap and employing loops that are easily adjusted and readily undone.

SUMMARY OF THE INVENTION

In accordance with the illustrative embodiments demonstrating features and advantages of the present invention, there is provided a personal harness for carrying at least one article. The harness has a shoulder strap with a pair of carrying ends. The harness also includes a pair of hitch means for holding at least the one article. This pair of hitch means is separately attached to the shoulder strap near the pair of carrying ends. Each of the hitch means includes a primary slide, a cinch strap and a clasp. The primary slide is slidably mounted on the shoulder strap. The cinch strap is attached to the primary slide. The clasp can detachably join the cinch strap and the corresponding one of the carrying ends of the shoulder strap.

In accordance with a related embodiment of the same invention, a method for carrying at least one article employs a shoulder strap that is attached at opposite ends through a respective clasp to a respective cinch strap that attaches back to a primary slide on the shoulder strap. The method includes the step of encircling at least a portion of the one article with the shoulder strap and the respective cinch strap, with the respective clasp open. Another step is closing the respective clasp. Another step is carrying at least the one article by shouldering the shoulder strap and walking.

By employing apparatus and methods of the foregoing type, an improved personal harness is achieved. In a preferred embodiment, each end of a shoulder strap is formed into a loop using a slide having three transverse bars. The slide is mounted near one end of the shoulder strap and the end of the shoulder strap connects through a quick-release fastener to a cinch strap that loops back to attach to the middle bar of the slide. The cinch strap itself has a slide to allow adjustment of the length of the cinch strap.

Thus the preferred harness has a loop that can be quickly opened and closed by means of the quick-release fastener. Moreover, the size of the loop can be adjusted by two different slides: the one slidably mounted on the shoulder strap, and the one on the cinch strap.

Because the loops on the ends of the harness are adjustable over a wide range, the harness can be used to carry a diverse array of products. In addition, the harness can be used quickly, since the loops can be readily undone by the use of quick-release fasteners. Also, in instances where the loop size needs to be increased, the quick-release fastener can be undone and an extension strap can be patched between the male and female parts of the fastener.

Thus, variously sized objects can be carried by quickly undoing each loop at the end of the shoulder strap, adjusting its size to fit the articles to be carried, and then closing the loop and adjusting the loops further, if required. Then the articles at each end of the shoulder strap can be carried with the shoulder strap slung over the user's shoulder.

In some instances, only a single article is carried, in which case both loops encircle this same article but at different positions. The article can then be carried either under an arm or around the neck and in front of the carrier. Alternatively, separate articles can be carried on different ends of the shoulder strap, in which case one article (or group of articles) is suspended in front of the user, and another article (or group of articles) is suspended behind.

The quick release fasteners of the preferred embodiment are a pair of clasps each having a male and female part. Therefore, the loops formed at both ends of the shoulder strap can be undone to expose the male and female parts of the clasp. Then a male part from a clasp at one end of the shoulder strap can be attached to a female part of the other clasp at the opposite end of the shoulder strap. Under these circumstances the harness can be worn much like a belt and can be used for various purposes including holding a child in a child seat or a shopping cart.

To facilitate the carrying of various types of articles, accessories can be attached to the straps. For example, a D-ring can be mounted around one of the straps. In addition, a clip can be attached to such a D-ring to provide a quick connecting fastener.

BRIEF DESCRIPTION OF THE DRAWINGS

The above brief description as well as other objects, features and advantages will be more fully appreciated by reference to the following detailed description of presently preferred, but illustrative embodiments according to the present invention, when taken in conjunction with the accompanying drawings, wherein:

FIGS. 6A–6D are schematic diagrams showing various modes of using the harness of FIG. 1;

FIG. 7 is a axonometric view of the harness of FIG. 1 shown carrying specific objects; and FIG. 8 is a schematic diagram of the harness of FIG. 1, showing it connected to operate as a belt for holding a child in a seat.

DETAILED DESCRIPTION OF THE PREFERRED EMBODIMENTS

Figure 2:
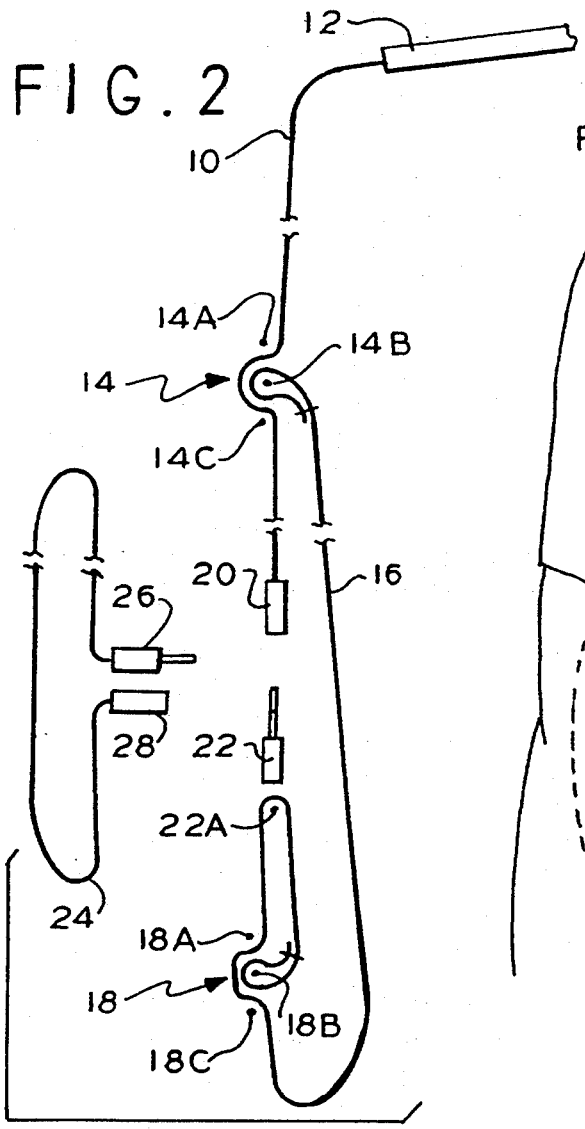
FIG. 2 is a schematic diagram of half of the harness of FIG. 1.

Referring to FIGS. 1, 2, 3 and 4, a personal harness is shown employing a shoulder strap 10 with a central shoulder pad 12. Shoulder strap 10 can be a nylon or polypropylene webbing, although cotton or other materials may be used instead. Alternatively, the various straps shown herein can be made elastic so that they fit more snugly around the article to be carried. Strap 10 is preferably 1 meter long and 2.5 cm wide, although the length and width can be altered depending upon the desired size, strength, flexibility etc. Shoulder pad 12 may be soft resilient plastic having slots through which the shoulder strap 10 can be laced. Alternatively, the shoulder pad 12 can be a soft foam or fabric tube through which the shoulder strap 10 passes. Alternatively, shoulder pad 12 can be a molded item that is permanently contoured to fit on a person's shoulder.

Slidably mounted on shoulder strap 10 is primary slide 14 comprising a sliding frame with three transverse bars 14A, 14B and 14C. Shoulder strap 10 is laced between the transverse bars to lie behind bars 14A and 14C and in front of the middle bar 14B. In some embodiments, the slide can be replaced with a buckle of various types; for example, a tension buckle such as that used with a waist belt. Such buckles have a pivotally mounted gate that can receive the belt and then be swung into a closed position to tightly hold the belt.

A cinch strap 16, made of the same material as strap 10, has one end formed into a loop that encircles middle transverse bar 14B with strap 10 passing on the outside of cinch strap 16. Cinch strap 16 (also referred to as a hitch means) is formed into this loop by sewing, glueing, riveting, stapling or otherwise securing a free end of cinch strap 16 back onto itself.

A portion of cinch strap 16 distal to primary slide 14 is laced through secondary slide 18, which is built the same as primary slide 14. Specifically, cinch strap 16 is laced in front of the middle transverse bar 18B and behind the other two bars 18A and 18C. The portion of cinch strap 16 thus laced through secondary slide 18 emerges and is turned to form a bight that then terminates on middle bar 18B of secondary slide 18. Cinch strap 16 is terminated by a loop that encircles and thereby attaches strap 16 to middle bar 18B of slide 18.

Figure 4:
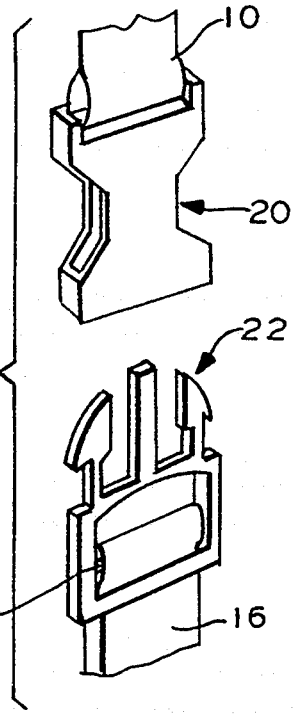
FIG. 4 is a detailed, axonometric view of the clasp of FIG. 1, undone.

The bight in cinch strap 16 formed on the distal side of slide 18 wraps around bar 22A of clasp 20, 22. The clasp is shown in FIG. 4 as a clasp plug 22 and clasp socket 20. Plug 22 is shown as a three pronged assembly having a transverse bar 22A around which the bight of strap 16 is wrapped. Socket 22 is shown as a rectangular, hollow, box-like structure having notches on opposite sides. Clasp 20, 22 is a conventional, one-inch quick-release fastener or buckle having a side squeeze feature.

In some embodiments shoulder strap 10 will be 36 inches long (92 cm) and cinch strap 16 will be 18 inches long (46 cm), although these dimensions can be varied depending on the size of the user, the desired holding capacity, etc. The loop formed with this cinch can be minimized to approximately 9 inches (23 cm) in circumference. On the other hand, slides 14 and 18 can be adjusted to make a maximum circumference of almost 36 inches (92 cm). In instances where even a larger circumference is required, the clasp elements 20 and 22 can be separated and spliced in series with an extension strap 24. Strap 24 can have an extension plug 26 and an extension socket 28 constructed identically to plug 22 and socket 20, respectively. The ends of extension strap 24 are formed into loops that fasten to items 26 and 28. Depending upon the length of extension strap 24 the circumference of the loop formed by the apparatus of FIG. 2 can be increased to almost any reasonable size desired.

Figure 5:
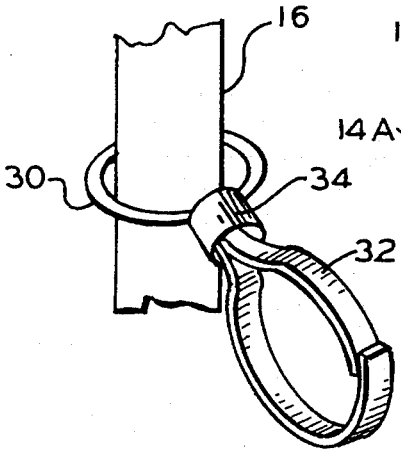
FIG. 5 is a detailed view of an optional D-ring and clip for one of the straps of FIG. 1.
Figure 3:
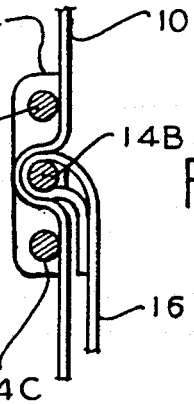
FIG. 3 is a detailed cross-section of one of the slides of FIG. 1.

FIG. 5 shows cinch strap 16 fitted with a D-ring 30. Such a ring 30 can also be placed around the shoulder strap (shoulder strap 10 of FIG. 2). Ring 30 is shown herein with a clip 32 made of spring steel so that another ring or similar article already mounted on an object to be carried can be clipped to clip 32. In this embodiment, clip 32 is connected through a swivel joint 34 to ring 30. Some embodiments may eliminate ring 30 or clip 32, or both.

Figure 1:
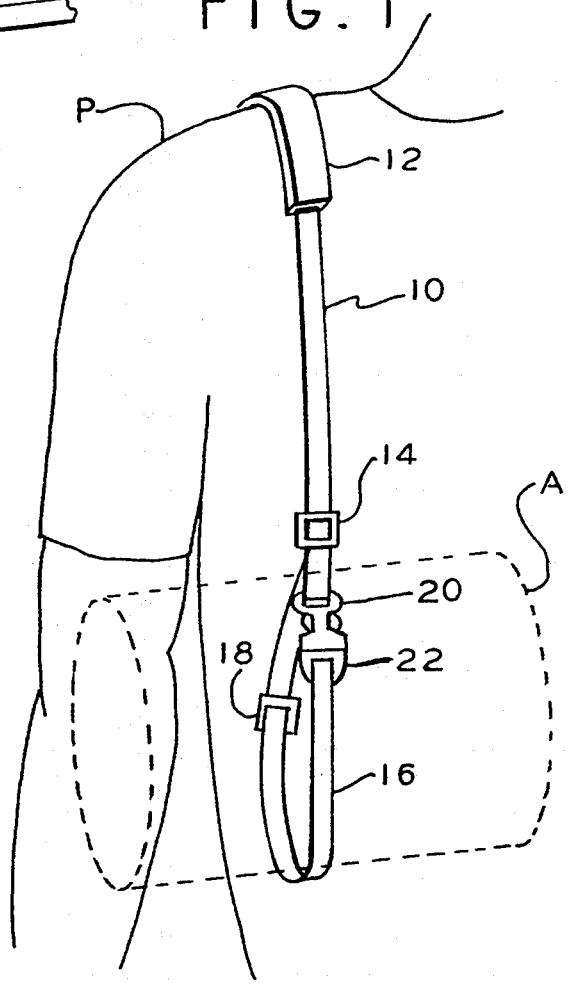
FIG. 1 is an axonometric view of a harness in accordance with the principles of the present invention.

To facilitate an understanding of the principles associated with the foregoing apparatus, its operation will be briefly described. Referring to FIG. 1, the harness is shown draped across the shoulder of a person P with the shoulder pad 12 centered on the shoulder. One carrying end of shoulder strap 10 is shown draped in front and it will be understood that the other carrying end is draped behind person P.

Before hoisting the harness onto a person's shoulder, the clasp 20, 22 is undone. The then open loop can encircle article A before closing clasp 20, 22. Article A is shown herein in phantom as a cylindrical object with its axis horizontal, although clearly other shapes can be carried as well.

Next, the circumference of the loop around article A is adjusted using slides 14 and 18. For mid-sized objects such as that shown in FIG. 1, either slide 14 or 18 can be adjusted to bring cinch 16 snugly around article A. For very small or very large articles, both slides 14 and 18 will need to be adjusted to their minimum or maximum positions. Another article (not shown) is similarly secured to the opposite end of shoulder strap 10.

Thereafter, shoulder strap 10 is hoisted onto the person's shoulder as shown in FIG. 1. Accordingly, one article will be suspended in front and the other article behind person P. The articles can then be carried conveniently with the person's hands kept free or used to steady the articles. When reaching the destination, the articles can be released by reversing the above process.

Referring to FIG. 6A, a single article B is shown connected to opposite ends of the shoulder strap 10. In this instance, cinches 16 are tightened around the ends of article B before shoulder strap 10 is hoisted onto the shoulder of person P. Thereafter, the article can be carried under the person's arm as illustrated.

Referring to FIG. 6B, a longer article C is shown similarly fastened to shoulder strap 10 using cinches 16. In this case, however, the front cinch 16 is raised closer to the shoulder of person P so the article C is kept under the arm but in a more erect position.

Referring to FIG. 6C, a large article D has the cinches 16 again fastened to it in a manner similar to that shown in FIG. 6A. In this instance however, shoulder strap 10 is worn around the neck to drape in front of the person P thereby allow frontal carrying.

Referring to FIG. 6D, the cinches 16 at opposite ends of shoulder strap 10 are secured around the periphery of articles E and F. Cinch 16 girds a cooler E, and the other cinch 16 encircles the legs of a beach chair F. Significantly, the legs of the beach chair F could not be encircled unless there were a clasp associated with cinch 16. Cinch 16 around beach chair F need not be tightened snugly around the legs of the beach chair, but is shown herein fitting loosely.

FIG. 7 illustrates an alternate and preferred way to carry a beach chair F and cooler E. Each of the two cinches 16 are looped through the handles H of the cooler E and around the legs or other frame members of beach chair F. The cinches are shown secured at spaced positions and can be kept loose as illustrated. Arranged this way, strap 10 can be draped over the shoulder of person P and the chair F and cooler E tucked under the arm of person P when walking.

Referring to FIG. 8, the harness is shown with all its clasps undone. It will be noted that a socket from one clasp can be attached to the plug of another clasp. This association is shown by dotted line 36. When connected in this fashion, shoulder strap 10 forms a belt. This belt can be worn around a person's waist. Alternatively, the belt thus formed can be used to hold a child into a car seat or in the seat in a shopping cart. The seats in shopping cart are usually formed of a grating-like structure. Therefore, the belt thus formed can be laced through the grating and around the waist of the child. Moreover, slide 18 can be used to tighten the belt thus formed around the child.

It is to be appreciated that various modifications may be implemented with respect to the above described preferred embodiments. For example, the width and length of the various straps can be altered as well as the material used to make the straps, depending upon the desired strength, capacity, flexibility etc. Also, the harness can be used to carry various articles such as beach chairs, umbrellas, coolers, sporting equipment (for example skis and ski boots), grocery bags, suitcases, musical instruments, rollerblades, windsurfing equipment, ice skates, etc. Also in some embodiments, the secondary slide can be eliminated where the range of adjustment is less demanding. The illustrated clasp is preferably a one inch side squeeze buckle, although in other embodiments a different releasing mechanism and different sizes can be employed, depending upon the desired strength, ease of use, compactness etc.

Obviously many modifications and variations of the present invention are possible in light of the above teachings. It is therefore to be understood that within the scope of the appended claims, the invention may be practiced otherwise than as specifically described.

I claim:

1. A personal harness for carrying at least one article, comprising:

a shoulder strap having a pair of carrying ends; and a pair of hitch means for holding at least said one article, said pair of hitch means being separately attached to said shoulder strap near said pair of carrying ends, each of said hitch means comprising:

a primary slide slidably mounted on said shoulder strap;

a cinch strap attached to said primary slide; and a clasp for detachably joining said cinch strap and a corresponding one of said carrying ends of said shoulder strap, said clasp, when closed, being closer to an adjacent one of said carrying ends than said primary slide and being operable to disengage said hitch means to release said article.

2. A personal harness according to claim 1 comprising:

a secondary slide slidably mounted on said cinch strap, said cinch strap passing through said secondary slide and looping through said clasp to attach back to said secondary slide.

3. A personal harness according to claim 2 wherein said primary and said secondary slide each comprise:

a sliding frame having three transverse bars.

4. A personal harness according to claim 3 comprising:

a shoulder pad centrally mounted on said shoulder strap.

5. A personal harness according to claim 4 wherein said clasp comprises:

a clasp socket and a clasp plug arranged to snap together.

6. A personal harness according to claim 5 further comprising an extension strap having an extension socket and extension plug adapted to be connected to said clasp plug and said clasp socket, respectively, so that the length of said cinch strap can be effectively extended.

7. A personal harness according to claim 6 comprising:

a ring encircling said cinch strap, so that objects can be secured to said ring.

8. A personal harness according to claim 6 comprising:

a ring encircling said cinch strap; and a clip attached to said ring, so that objects can be secured to said ring.

9. A personal harness according to claim 1 wherein said clasp comprises:

a clasp socket and a clasp plug arranged to snap together, said personal harness further comprising:

an extension strap having an extension socket and extension plug adapted to be connected to said clasp plug and said clasp socket, respectively, so that the length of said cinch strap can be effectively extended.

10. A personal harness according to claim 1 wherein said cinch strap is elastic.

11. A personal harness for carrying at least one article, comprising:

a shoulder strap having a pair of carrying ends; and a pair of hitch means for holding at least said one article, said pair of hitch means being separately attached to said shoulder strap near said pair of carrying ends, at least one of said hitch means comprising:

a primary slide slidably mounted on said shoulder strap; and a clasp having a first clasping member flexibly attached to and drawn by said slide, and a second clasping member attached to said shoulder strap at a location distal from said slide, said first and said second clasping members being detachably joinable to form with at least a portion of said shoulder strap a cinch loop, said clasp, when closed, being distal on said shoulder strap in comparison to said slide, said clasp being operable to disengage said hitch means to release said article.

* * * * *